US011530518B1

(12) United States Patent
Lloyd

(10) Patent No.: US 11,530,518 B1
(45) Date of Patent: Dec. 20, 2022

(54) SHORELINE EROSION PROTECTION USING ANCHORED CONCRETE BOULDERS

(71) Applicant: Daniel D. Lloyd, Houston, TX (US)

(72) Inventor: Daniel D. Lloyd, Houston, TX (US)

( * ) Notice: Subject to any disclaimer, the term of this patent is extended or adjusted under 35 U.S.C. 154(b) by 0 days.

(21) Appl. No.: 17/486,208

(22) Filed: Sep. 27, 2021

(51) Int. Cl.
*E02B 3/12* (2006.01)

(52) U.S. Cl.
CPC ..... *E02B 3/123* (2013.01)

(58) Field of Classification Search
CPC ..... E02B 3/123; E02B 3/126; E02B 3/127; E02B 3/04; E02B 3/12; E02D 29/0291; E02D 29/0233
See application file for complete search history.

(56) References Cited

U.S. PATENT DOCUMENTS 4,000,619 A 1/1977 Ziegler
4,135,843 A 1/1979 Umemoto et al.
4,420,275 A 12/1983 Ruser
4,425,052 A * 1/1984 McCullers ..... E02B 3/04 405/32
4,449,847 A 5/1984 Scales et al.
4,486,121 A 12/1984 Thompson et al.
4,693,632 A 9/1987 Ingersoll
4,952,098 A * 8/1990 Grayson ..... E02D 29/0233 405/262
4,954,013 A 9/1990 Lamberton
5,582,492 A * 12/1996 Doyle, Jr. ..... E02D 29/0233 405/262
6,109,835 A 8/2000 Grabhorn
7,021,869 B2 4/2006 Sanguinetti
7,029,205 B2 4/2006 Daigle
7,452,164 B2 11/2008 Kim
7,922,421 B2 4/2011 McGillick, Sr. et al.
8,939,681 B2 1/2015 Pienaar et al.
9,745,713 B2 8/2017 Breitenbeck
9,758,939 B2 9/2017 Adams
9,932,716 B2 4/2018 Pickup et al.
2003/0213203 A1* 11/2003 Bott ..... E02D 29/0241 52/603
2007/0140598 A1* 6/2007 McGillick ..... B65D 88/1625 383/117
2009/0169301 A1 7/2009 Kim
2010/0303548 A1 12/2010 Daily
2011/0173932 A1 7/2011 John
2013/0322789 A1* 12/2013 Lin ..... E02B 3/127 383/117
2015/0240437 A1* 8/2015 Goddard ..... E02B 3/127 405/114
2018/0347141 A1* 12/2018 Ruel ..... E02D 29/0266
2019/0234042 A1* 8/2019 Burkett ..... E02B 3/124

* cited by examiner

*Primary Examiner* — Benjamin F Fiorello
(74) *Attorney, Agent, or Firm* — Roger N. Chauza, PC

(57) ABSTRACT

Man-made boulders anchored to a grade beam to prevent erosion of a bulkhead. The boulders are fabricated using woven bags filled with concrete and located on the water side of the bulkhead. An anchor bolt is embedded in the top surface of the boulder concrete. A concrete grade beam equipped with anchor bolts is located on the land side of the bulkhead. Cables are threaded between the anchor bolts of the concrete boulders and the anchor bolts of the grade beam. The weight of the concrete boulders plus the tensioned cables provide a structure that resists movement and protects the bulkhead from deterioration due to wave action. If upgrade soil protection is needed, rock-filled gabion cages can be installed over the grade beam.

20 Claims, 2 Drawing Sheets

SHORELINE EROSION PROTECTION USING ANCHORED CONCRETE BOULDERS

TECHNICAL FIELD OF THE INVENTION

The present invention relates in general to erosion control products and techniques, and more particularly to the fabrication of large boulders and for anchoring the same along a shoreline.

BACKGROUND OF THE INVENTION

A natural consequence of the movement of water is the corresponding erosion of soil that borders the body of water. Efforts continue to this day to prevent the erosion of shorelines to preserve the land. The erosion of the soil occurs because the flowing water, such as in a river or stream, tends to carry with it the soil that constitutes the shoreline. The movement of water, such as in a lake, sea or ocean, causes waves that attack the shoreline and constantly erode the corresponding soil. As used herein, the term "soil" can include sand and rocks that often accompany the soil that constitutes a shoreline. If the erosion is not controlled, then the shoreline continues to erode. This erosion not only contaminates the water, but moves the soil downstream to accumulate and reduce the depth of the body of water. The eroded shoreline often reduces the acreage of the adjoining land for landowners, and in certain instances can cause the loss of houses and other structures. In addition, the erosion of the shoreline causes the soil to be deposited downstream and result in unwanted deltas and fill dirt.

Efforts to prevent the erosion of a shoreline include various techniques. One method to prevent the erosion is to pile large rocks (rip-rap) along the shoreline to provide a barrier between the waves or flowing water and the shoreline. The water thus impacts the rock barrier rather than the shoreline soil, and the displacement of the soil is avoided. Another technique well known in the art is the use of retaining walls of various types. A retaining wall is an upright structure that is often embedded in the ground at the shoreline, and protrudes upwardly so that the soil behind the retaining wall is isolated from the body of water. Retaining walls can be constructed of metal, PVC material, concrete, etc. Yet another technique for preventing the erosion of a shoreline is to employ interlocking concrete blocks so that the movement of the water occurs on the concrete blocks, and not on the soil of the shoreline. These and other techniques are well known to prevent the erosion of the shoreline soil.

Other techniques for controlling the erosion of shorelines include containers that include bags, sleeves, tubes, etc., that are constructed of synthetic and fibrous materials. The containers are filled with sand, grout, concrete and other heavy materials to anchor the containers in place so that the movement of the water does not displace the containers. Various patents disclosing these techniques include U.S. Pat. Nos. 4,135,843; 4,420,275; 4,449,847; 4,486,121; 4,693,632; 7,922,421; 9,758,939 and 9,932,716.

There are certain instances where an existing shoreline protection structure becomes deteriorated and the reconstruction or repair thereof is not cost effective. Also, the marine vehicles required to repair the existing shoreline protection structure may not be able to access the structure as the depth of the water is inadequate. In this case, the vehicles and personnel needed to repair the structure can only access the same by land. Sometimes large rock riprap is suitable for use in front of the existing shoreline structures so that the waves or flowing water impacts the large-rock riprap and reduces the deterioration of the existing shoreline protection structure. It is difficult, if not impossible, to anchor the riprap in an economical manner to prevent movement thereof. Generally, if the movement of riprap is to be prevented due to wave action, then larger riprap is employed. However, if the restoration of the existing shoreline structure is not accessible via the water, then the large riprap must be trucked over land, which is costly and often involves the temporary destruction of the landscape.

In view of the foregoing, it can be seen that a need exists for a technique to place large man-made riprap or boulders on a shoreline to prevent erosion of the shoreline. Moreover, a need exists for a technique to utilize large boulders and the like, for shoreline erosion protection without transporting the large boulders themselves to the shoreline site, either by water or land. A further need exists for a technique for fabricating the boulders on site, and anchoring the man-made boulders to prevent movement thereof.

SUMMARY OF THE INVENTION

In accordance with the principles and concepts of the invention, disclosed is a technique for protecting bulkhead structures from deterioration due to the wave action of water, and from flowing water. According to an embodiment of the invention, man-made boulders are fabricated on site and located on the water side of the bulkhead. An anchor structure is fabricated and located on the land side of the bulkhead. Anchor mechanisms are embedded in the man-made boulders as well as in the anchor structure. Steel cables are run between the anchor mechanisms of the man-made boulders and the anchor structure to thus fix the boulders on the water side of the bulkhead.

In accordance with the features of the invention, rock-filled gabion cages can be overlaid on the anchor structure to prevent uphill erosion of the soil behind the bulkhead.

In order to anchor the rock-filled gabion cages against movement, rebar stubs are extended upwardly from the anchor structure and protrude into the wire frame of the gabion cages. When filled with rock, the rebar stubs are surrounded by rocks and prevent sideways movement of the rock-filled gabion cages.

A further feature is that bags constructed of a synthetic material are employed to fabricate the boulders. The bags are placed in front of the bulkhead and filled with concrete. While the concrete is still wet, anchor eye-bolts are embedded in the top surface thereof. If the boulders are to be located in the water, then the bags are weighted with a small amount of concrete, and then lowered into the water where the bags are filled with wet concrete. With this technique, there is no need to transport or carry large boulders to the worksite. If the site has water that is deeper than the height of the bags, then divers may be required to both guide the partially-filled bags into place in contact with a neighbor bag, so that it can be filled with wet concrete. Moreover, a diver may be required to place the anchor bolt in the top surface of the wet concrete that fills the bag. When working with underwater conditions, the efforts are facilitated by conducting the work when the waves and water turbulence is minimal.

An additional feature is that the cables extended between the boulders and the anchor structure confine the bulkhead and prevent movement thereof as well as prevent further deterioration by the movement of the body of water.

An important advantage is that the cables extended between the man-made boulders and the anchor structure are installed in a zig-zag pattern so that fewer cable clamps are needed, and less time is required to complete the anchor apparatus.

In accordance with an embodiment of the invention, disclosed is apparatus for preventing erosion of soil by water. The apparatus incudes a container having sidewalls, a bottom and an open top. The container is filled with concrete, and the concrete-filled container is located adjacent to an area to be protected from erosion. An anchor mechanism is at least partially embedded in the concrete, and the anchor mechanism is anchored to maintain the concrete-filled container adjacent to the area to be protected from erosion.

In accordance with a further embodiment of the invention, disclosed is apparatus for preventing erosion of soil by water. The apparatus includes a plurality of concrete boulders, where each concrete boulder has embedded therein an anchor bolt. The plural concrete boulders are arranged in a row in front of a structure to be protected from erosion. A plurality of anchor mechanisms are located on a land side of the structure, and each anchor mechanism is anchored on a land side of the structure. One or more cables extend from respective anchor bolts of the concrete boulders to the land side anchor mechanisms so that said cables overlie the structure to be protected from erosion.

In accordance with an embodiment of the invention, disclosed is a method for preventing erosion of soil by water. The method includes fabricating a plurality of concrete boulders. Each concrete boulder is fabricated so as to have embedded therein an anchor bolt. The plural concrete boulders are arranged in a row in front of a structure to be protected from erosion. Anchor mechanisms are placed on a land side of the structure, and the anchor mechanisms are anchored in the land side ground material. One or more cables are placed between each of the concrete boulder anchor bolts and the land side anchor mechanisms so that the cables overlie the structure to be protected from erosion.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
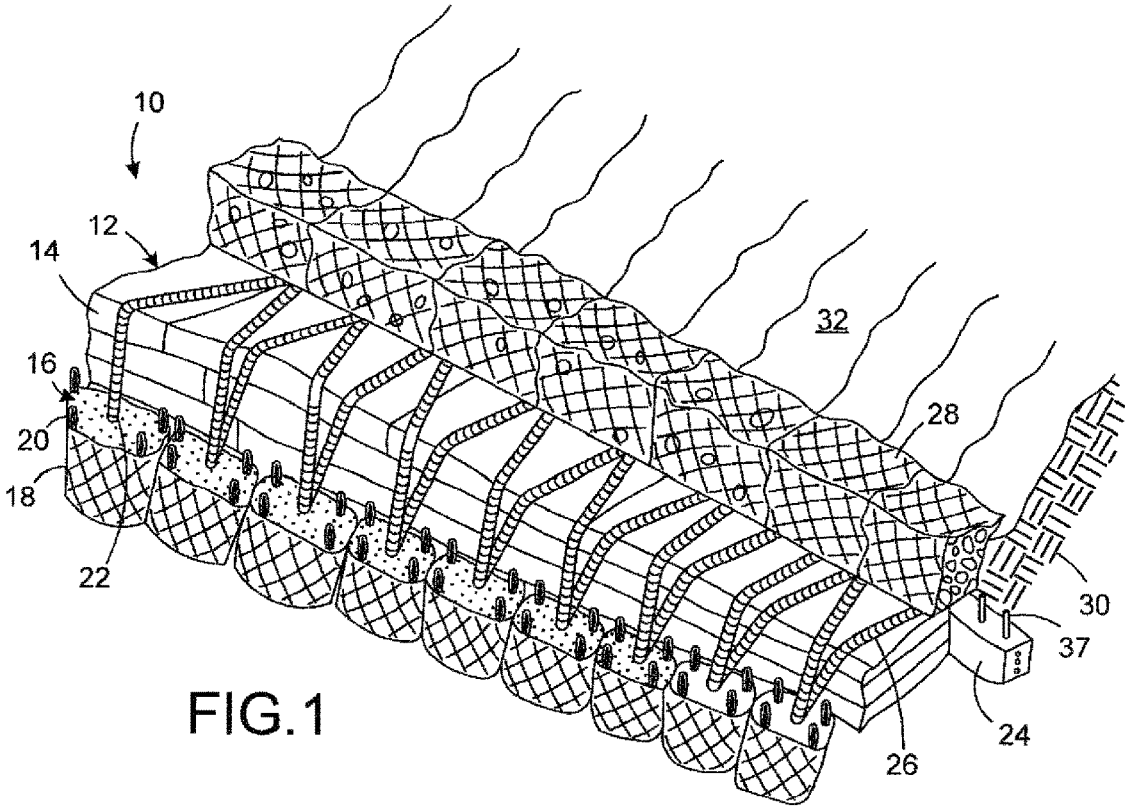
FIG. 1 is an isometric view of an example of the technique for anchoring man-made boulders to prevent erosion.

With reference to FIG. 1, there is illustrated the various components 10 for controlling the erosion and further deterioration of a bulkhead which separates the body of water from the shoreline. In the example, the bulkhead 12 comprises multiple layers of concrete panels 14. This type of bulkhead 12 is constructed by employing 10-inch thick concrete pavement which has been sawed to desired sizes, such as 6 feet by 10 feet. This practice was thought to efficiently dispose of old concrete pavement, and provide a barrier to the wave action of water bodies. However, over time the panels 14 of concrete which define the bulkhead 12 often deteriorate, become undercut by the water movement, or fall and eventually compromise the erosion protection originally provided.

The principles and concepts of the invention can be applied not only to the pavement panel bulkhead 12, but can also be applied to deteriorated retaining walls or bulkheads constructed of wood, steel, PVC material, etc., and even riprap. The man-made boulders can also be placed in specific areas to function as wave dissipaters to reduce the kinetic energy of the waves and thus reduce shoreline erosion. There are many other applications to which the invention disclosed herein can be applied. Moreover, the erosion barrier of the invention can be utilized even before the original bulkhead or retaining wall has deteriorated, but to prevent it from eventual deterioration.

Returning to FIG. 1, the frontal surface of the bulkhead 12 is protected from the wave action by the utilization of large concrete barriers, or boulders 16. The concrete boulders 16 are fabricated on site by employing synthetic fabric bags 18 of the type having loops 20 attached to the upper brim of the bag 18. The bags 18 are filled with concrete 16, and while yet wet, an anchor eye-bolt 22 is pushed into the top surface of the wet concrete. A grade beam 24 is formed in the ground behind the bulkhead 12, and anchor eye-bolts are set therein in a manner similar to those 22 fixed in the boulders 16. The grade beam 24 functions as an anchor that is stable and unmovable. A stainless steel cable 26 is threaded through the eye-bolts of each of the concrete boulders 16 and the eye-bolts (not shown in FIG. 1) of the grade beam 24. As illustrated in FIG. 1, the cable or wire rope 26 is installed so as to form a zig-zag pattern between the eye-bolts of the concrete boulders 16 and the eye-bolts of the grade beam 24. Lastly, the gabion cages 28 are installed so as to overlie the grade beam 24, as well as the back portion of the concrete panel 12 and the ground 30. The gabion cages 28 are then filled with rock suitable for use with the particular type of gabion cages employed. The gabion cages 28 filled with rock function to prevent the erosion of the soil 32 upgrade from such cages 28. The erosion of the upgrade soil can be caused by large waves that breach the concrete boulders 16 and the bulkhead 12, as well as runoff water flowing down the upgrade. The fabrication and installation process is described in further detail in connection with FIG. 2.

As can be appreciated, the utilization of the concrete boulders 16 allows the same to be fabricated on site without expensive equipment, can be of any desired size, and are all anchored so that movement thereof is prevented. The size of the concrete boulders 16 depends on the size of the woven bag 18 employed, and can be placed at any desired location in front of the concrete panels 14. Importantly, the barriers 16 can be fabricated in the water, so that the concrete cures in a more stable manner. Also, the concrete boulders 16 can be fabricated by workers on land so that access via the body of water is not necessary. This is extremely helpful when the water by the shoreline is shallow, or there is a low tide, and marine vessels cannot gain access to the work site. Even when the water is shallow, the bulkhead 12 can be impacted and eroded during storms when waves form, either during low or high tides.

Figure 2:
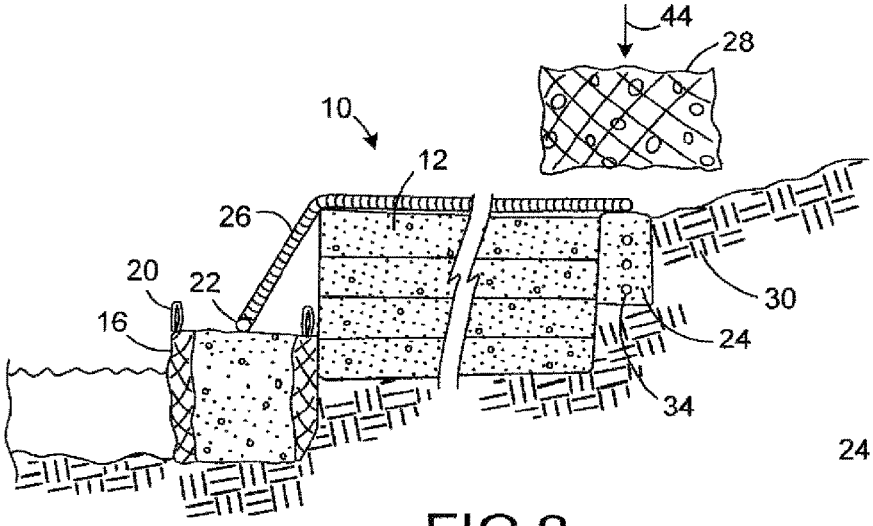
FIG. 2 is a cross-sectional view of the manner in which the man-made boulders are anchored to a grade beam.
Figure 3:
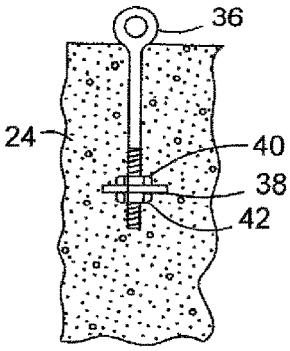
FIG. 3 is a cross sectional view of the grade beam with an eye-bolt anchored therein.
Figure 4:
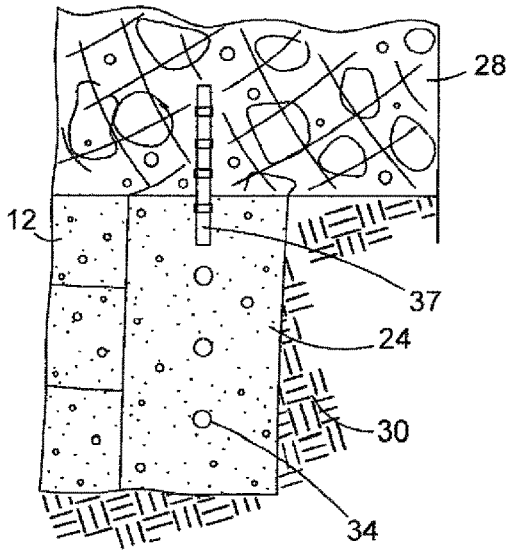
FIG. 4 is a cross-sectional view of the grade beam with lateral reinforcing rebar therein, as well as a rebar stub extending upwardly for engaging with the overlying gabion cages.

Referring to FIG. 2, there is illustrated a cross-sectional view of the system constructed according to an embodiment of the invention. Here, the concrete panels 14 are shown piled one on top of the other, on the underlying earth, rocks, sand, etc. A trench is dug in the soil behind the concrete panels 14 on the land side for forming the concrete grade beam 24 therein. In practice, the trench can be about two feet wide and two feet deep—all along the land side of the concrete panels 14. The trench can be formed using a backhoe or other equipment. If additional strength is desired for the grade beam 24, then lateral rebar rods 34 can be used in the trench, one over the other. In the preferred embodiment, three rebar runs 34 are utilized (FIG. 4). Next, concrete is poured in the trench to form the grade beam 24 that is anchored in the ground and abuts the backside of the concrete panels 14. While the grade beam concrete is still wet, spaced-apart hooks 36 are inserted therein. The hooks 36 can include eye-bolts. This is illustrated in FIG. 3. The eye-bolts 36 are of standard construction with a galvanized coating and about nine inches long and ⅜ inch in diameter. The eye-bolts 36 are threaded so that a galvanized washer 38 can be inserted thereon and captured by a top galvanized nut 40 and a bottom galvanized nut 42. This arrangement prevents the washer 38 from moving when the bottom section of the eye-bolt 36 is pushed into the top surface of the grade beam concrete 24. As can be seen, the bottom of the eye of the bolt 36 is flush or somewhat below the surface of the concrete 24. This prevents bending or breaking of the eye-bolt 36 due to the load placed thereon by the wire rope 26 threaded therethrough.

While the concrete of the grade beam 24 is yet wet, short lengths of rebar 37 are pushed vertically down into the grade beam concrete 24. This is illustrated in FIG. 4. The rebar 37 can be of sufficient length so that about eight inches thereof protrudes above the top surface of the grade beam concrete, and are spaced apart about one foot. The vertical rebar 37 can be #4 in size, much like that of the lateral runs 34. The function of the vertical rebar 37 is to protrude into the overlying gabion cages 28 to stabilize the same and prevent movement. Stated another way, the vertical rebar 37 anchor the overlying gabion cages filled with rock and prevent lateral movement due to large waves, as well as prevent movement due to the uphill soil 32 pushing downhill on the gabion cages 28.

After the formation of the grade beam 24, the concrete boulders or barriers 16 are fabricated on site. In accordance with the invention, the concrete boulders 16 are effectively man-made boulders, but can be constructed of any size desired. Also, the man-made boulders 16 need not be lifted or carried, and are constructed in place using large bag-type containers 18 and poured concrete. In the preferred embodiment, the containers can be woven bags 18 with open tops and lifting loops 20. In the preferred embodiment, the bags 18 are bulk bags constructed as woven polypropylene storage bags having corners so that the containers retain somewhat of a square cross-sectional shape. Such bags 18 can be obtained from Uline.com, or from other suppliers. The woven containers 18 employed in connection with the invention are fifty cubic foot containers and are identified as Uline model number S-19913. Preferably, the bags 18 are constructed with a lifting loop 20 at each corner of the bag 18. Many other bags suitable for use with the invention can be utilized with equal effectiveness. The polypropylene material of the bags 18 deteriorates over time when submerged in water and when continually rubbed against the concrete boulders by the wave action, leaving the hardened concrete therein to function as large concrete boulders 16.

It should be noted in connection with the fabrication of the man-made boulders 16 that the partially concrete filled bags 18 can be lifted by a forklift by inserting the forklift tines into two opposite loops 20. Alternatively, the bags 18 can be lifted from a single central lifting point using a metal sling fixture having four arms perpendicular to each other. The fixture resembles a cross with four equal-length arms. A bag loop 20 is looped over the end of each respective arm, and the sling fixture is lifted at its center point together with the partially-filled concrete bag 18. The bag 18 can then be lowered to the desired position in front of the concrete panels 12.

In practice, the bag 18 is attached to the lifting fixture, which is suspended by a chain, cable or other tether of a backhoe, excavator or other suitable motorized lifting apparatus so that the bag opening is readily available. Then, the bag 18 is partially filled with concrete to provide a suitable weight so that when the partially-filled bag 18 is lowered into the water, the bag 18 will not float or collapse. If the man-made boulders 16 are to rest on the ground without water, the bag 18 can be laid directly on the ground and then filled with concrete. In any event, once the partially-filled bag 18 is in place, then it is completely filled with concrete to the top. Because of the volume of concrete needed, it is practical to employ premixed concrete that is delivered by a truck equipped with a rotating mixer. For locations that are difficult to access, a truck with a cement pump can be utilized. Those skilled in the art can readily determine the type of concrete suitable for either underwater applications or applications where the concrete-filled bags 18 are partially or wholly out of water. When the bag 18 is of the size that holds fifty cubic feet of concrete, it weighs about 7,500 pounds. As such, the man-made boulder 16 is not easily moved, even when impacted with large waves.

Before the concrete in the bag 18 sets, an anchor eye-bolt is manually inserted therein, generally in the middle of the top surface of the wet concrete 16. This is illustrated in FIG. 3 which shows the anchor eye-bolt 36 that is fixed in the concrete grade beam 24. The same technique is employed to anchor an eye-bolt in the wet concrete that fills the bag 18. In any event, a conventional galvanized nine-inch long, ⅜ inch diameter eye-bolt is equipped with a galvanized washer 38 and two galvanized nuts 40 and 42. The eye-bolt is of the type having an eye with a diameter of about one inch, or sufficient diameter to allow a wire rope 26 to pass therethrough. The eye-bolt 36 is pushed into the wet bag concrete until the bottom of the eye is level with the surface of the concrete. It can be appreciated that when the concrete sets, the washer 38 allows large loads to be placed on the eye-bolt 36 without pulling it out of the concrete.

The concrete-filled bags 18 can be placed in front of the bulkhead, as shown, or in front of a retaining wall or other erosion control apparatus. The bulkhead can be lined with the concrete-filled bags 16 to protect the bulkhead from deterioration or erosion. When desired, the concrete-filled bags 16 can be installed in rows, i.e., a row directly in front of the bulkhead 12, and installed as a second row in front of the first row of concrete-filled bags. Moreover, the concrete-filled bags 16 can be stacked on top of each other to increase the height of protection to the bulkhead 12. In order to achieve different effects, different size bags 18 can be utilized in a single installation. While the bag 18 of the preferred embodiment is described above, those skilled in the art may find that bio-degradable bags can be employed.

Such type of bags are described in U.S. Published Pat. App. No. 2011/0173932, and elsewhere.

Once the bags 18 of concrete are all in place and set, they can be anchored so as to further assure that there is no movement of the man-made boulders 16. In addition to the weight of the concrete-filled bags 18, the further anchoring allows the concrete boulders 16 to remain in place even if they are undercut by wave action. Any tendency of the concrete boulders 16 to roll or tilt is also minimized by the tension thereon of the cables 26.

Figure 5:
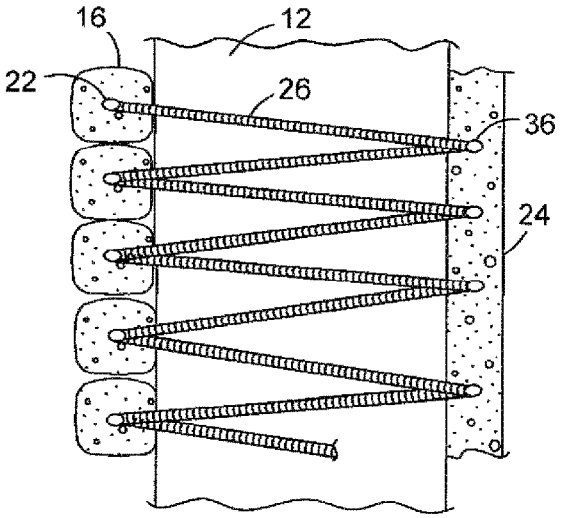
FIG. 5 is a top view of the system illustrating the manner in which the wire rope is threaded between the concrete barriers and the grade beam.

FIG. 5 illustrates one technique for anchoring the concrete boulders 16 with cables, also referred to as wire ropes. A long length of a ¼ inch galvanized cable 26 is used to anchor the concrete boulders 16 to the grade beam 24. As an alternative, and although more expensive, stainless steel cables can be employed. An end of the cable 26 is anchored to the eye-hook 22 of the first boulder 16 by looping the cable end around the eye and using a pair of cable clips. The cable clips can be of the standard galvanized type having a U-shaped bolt installed around the two cable strands and with a clip saddle and two nuts. The looped cable is fastened to the bolt eye 22. The cable clips are otherwise known as cable clamps. The cable 26 is then threaded through the bolt eye 36 of the grade beam 24, back through the bolt eye of the second concrete-filled bag, then to the second bolt eye of the grade beam 24, and so on in a zig-zag manner. Once the end of the cable 26 is reached, it is tensioned by hand and looped around the remaining bolt eye [bolt-eye], and secured with a second pair of cable clamps. If plural cables 26 are required to fulfill the overall length requirements of the system, the ends of the plural cables can be spliced or attached together using cable clamps. This zig-zag pattern of the cable 26 is efficient as it requires few cable clamps and less time. With this arrangement, because the grade beam 24 is firmly anchored in the ground and on the backside of the concrete panels 14, the concrete boulders 16 are correspondingly anchored against movement by the tensioned cables 26.

An alternative way to anchor the concrete boulders 16 to the grade beam 24 is to utilize individual lengths of cable and secure each boulder 16 to the grade beam 24 with a respective cable. With this arrangement, there is an individual cable tensioned between each boulder 16 and the grade beam 24. This alternative has the advantage that if a single cable fails, the other cables will remain effective to hold the respective boulders 16 in place.

While the concrete grade beam 24 is effective to anchor the cables 26 on the land side of the bulkhead 12, those skilled in the art may choose to provide a different type of anchor mechanism. For example, heavy duty metal rods can be used and anchored in the ground. Such metal rods well adapted for use as anchor mechanisms include an eye at one end and an auger at the other end. The auger part can be augered into the ground so that only the eye is accessible. The cable can be either threaded through the eye of the auger rod and attached thereto using a pair of cable clamps. Other anchor mechanisms are readily available in the prior art, including dead men driven into the ground to provide individual anchor structures for the cable 26.

As illustrated in FIGS. 1 and 2, the cables 26 extend generally in an angled manner upwardly from the concrete boulders 16 and over the corner of the top-most concrete panel 14 and are then angled to the anchor point of the grade beam 24. With this arrangement, the cables 26 stabilize the concrete panels 12 against upward, sideward or outward movement. The movement and possible erosion or deterioration of the concrete panels 12 is thus arrested. The cables 26 thus tend to contain or compress the components of the system together and resist relative movement.

If it is desired to prevent erosion of the uphill grade 32 (FIG. 1), then either riprap or rock-filled gabion cages 28 can be employed. In the preferred embodiment, rock-filled gabion cages 28 are utilized to prevent such erosion. A suitable geotextile material is laid on the ground to be protected from erosion. The wire cages 28 are installed on top of the grade beam 24, overlying a back part of the concrete panels 14 as well as the geotextile material that covers the ground 30 (FIG. 2). The wire cages 28 are lowered in the direction of arrow 44 onto the vertical rebar stubs 37 until the vertical rebar stubs 37 protrudes through the wire bottom of the gabion cages 28. The wire cages 28 are then attached together using hog clamps or other suitable fasteners. The cages 28 are then filled with a suitable size rock, and the cage top lids are closed and secured. As can be appreciated, the rock filling surrounds the vertical rebar stubs 37 and prevents movement of the rock-filled cages 28. The rock-filled cages 28 overlap onto a part of the ground 30 and prevent erosion around the grade beam 24. Similarly, the frontal part of the rock-filled cages 28 overlies the back part of the concrete panels 14 and prevents deterioration or movement of such part of the bulkhead panels 14. When the ground 30 behind the concrete panels 14 is level, then the rock-filled gabion cages 28 may or may not be needed.

Figure 6:
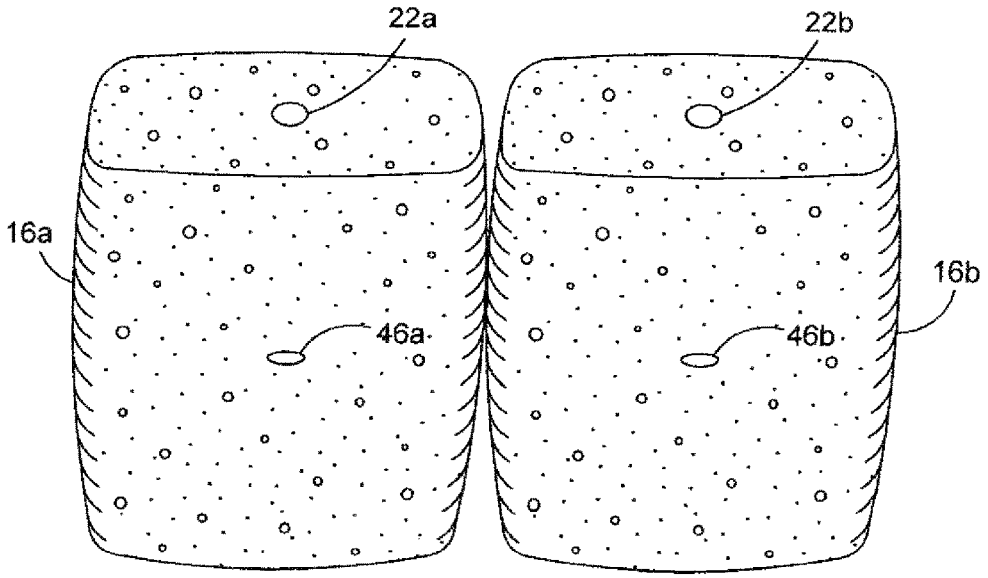
FIG. 6 is an isometric view of a pair of man-made boulders installed side by side, and after the outer woven bags have been eroded away.

FIG. 6 illustrates a first man-made boulder 16*a* after the outer synthetic bag material has deteriorated and washed away. The first man-made boulder 16*a* is poured adjacent to a second neighbor man-made boulder 16*b*. The shape of the boulders 16*a* and 16*b* have generally vertical corners that are somewhat square. This is due to the shape of the synthetic bags 18 from which the concrete boulders 16*a* and 16*b* are formed. Further forming the shape of the boulders 16*a* and 16*b* is the aspect that when the bag full of wet concrete is laid in contact with the neighbor bag of concrete, the outer surface of the wet concrete conforms to the shape of the neighbor bag of concrete. This facilitates the close contact between the man-made boulders 16*a* and 16*b* so that less water is able to flow therebetween and contact the bulkhead 12. The close conforming contact between neighbor rocks of riprap is not possible, as the shape of the rocks is fixed before being randomly dumped in place. The only way to reduce the space between large riprap is to dump smaller rock on top of the larger rocks. This is only a temporary remedy, as the waves will wash the smaller rock out of the crevices of the larger rock.

The placement of the cable anchors to the concrete boulders 16 is not limited to the top surface of the boulders 16. Indeed, the eye-bolts 22 can be placed on any surface of the concrete boulders 16. As illustrated in FIG. 6, eye-bolts 46*a* and 46*b* can extend from the side surfaces of the concrete boulders 16*a* and 16*b*. This can be accomplished while the concrete is still wet by pounding the eye-bolts 46*a* and 46*b* laterally through the bag material and into the wet concrete. With this technique, the sides of the concrete boulders 16 can be anchored together in rows to each other, or anchored to yet other structures. Eye-bolts can even be pounded into the bottom of the wet partially-filled bags 18, and have short lengths of cable attached to the eye-bolts so that when the bag is filled with concrete, the short cable extends beyond the bag and can be accessed for connection to another anchor cable or structure.

While the preferred and other embodiments of the invention have been disclosed with reference to specific erosion control components, and associated methods of fabrication thereof, it is to be understood that many changes in detail may be made as a matter of engineering choices without departing from the spirit and scope of the invention, as defined by the appended claims.

What is claimed is:

1. Apparatus for preventing erosion of soil by water, said apparatus comprising:

a container having sidewalls, a bottom and an open top;

concrete filling said container;

said concrete-filled container located adjacent to an area to be protected from erosion;

an anchor mechanism at least partially embedded in said concrete, said anchor mechanism anchored to maintain said concrete-filled container adjacent to said area to be protected from erosion; and at least one cable extended from the anchor mechanism of said concrete-filled container to a remote anchor location so that said at least one cable overlies the area to be protected from erosion.

2. The apparatus of claim 1, wherein said anchor mechanism includes an eyebolt.

3. The apparatus of claim 1, wherein said anchor mechanism is adapted for anchoring said at least one cable thereto.

4. The apparatus of claim 1, wherein said container comprises a bag that includes a top rim defining said open top, and wherein said bag is constructed with a woven material, and includes plural loops attached around said rim.

5. The apparatus of claim 1, further including an elongate grade beam constructed of concrete, said grade beam having an anchor mechanism to which said at least one cable is anchored, whereby said grade beam is located on one side of said area to be protected and said concrete-filled container is located on an opposite side of said area to be protected.

6. The apparatus of claim 5, further including plural concrete-filled containers, and said grade beam includes plural anchor mechanisms, and including one or more said cables attaching the anchor mechanisms of said concrete-filled containers to the anchor mechanisms of said grade beam.

7. The apparatus of claim 6, wherein one said cable extends between said concrete-filled containers and the anchor mechanisms of said grade beam in a zig-zag pattern.

8. The apparatus of claim 5, further including a bulkhead to be protected from said erosion, and including a plurality of said concrete-filled containers, wherein said concrete-filled containers are located on a water side of said bulkhead, and said grade beam is located on a land side of said bulkhead.

9. The apparatus of claim 8, wherein said bulkhead comprises at least one concrete panel oriented horizontally.

10. The apparatus of claim 9, wherein said bulkhead comprises plural said concrete panels, each stacked one over another.

11. The apparatus of claim 8, wherein said bulkhead comprises one of a metal retaining wall, a wood retaining wall, a synthetic retaining wall or a riprap barrier.

12. The apparatus of claim 5, further including one or more rock-filled gabion cages overlying said grade beam.

13. The apparatus of claim 12, wherein said grade beam includes at least one vertical rebar stub that protrudes into each said gabion cage.

14. Apparatus for preventing erosion of soil by water, said apparatus comprising:

a plurality of concrete boulders, each concrete boulder having embedded therein an anchor bolt, said plural concrete boulders arranged in a row in front of a structure to be protected from erosion;

a plurality of anchor mechanisms located on a land side of said structure, each said anchor mechanism anchored on the land side of said structure; and one or more cables extending between respective anchor bolts of said concrete boulders and the land side anchor mechanisms so that said cables overlie said structure to be protected from erosion.

15. The apparatus of claim 14, further including one or more rock-filled gabion cages located adjacent to said anchor mechanisms on the land side of said structure.

16. The apparatus of claim 14, wherein each said anchor bolt embedded in said concrete boulders comprises an eye bolt.

17. The apparatus of claim 14, wherein said anchor mechanisms are anchored to an elongate concrete grade beam embedded in a ground material.

18. The apparatus of claim 14, wherein said one or more cables extend between the anchor bolts of said concrete boulders and said anchor mechanisms in a zig-zag manner.

19. A method for preventing erosion of soil by water, said method comprising:

fabricating a plurality of concrete boulders, each concrete boulder fabricated so as to have embedded therein an anchor bolt, and arranging said plural concrete boulders in a row in front of a structure to be protected from erosion;

placing anchor mechanisms on a land side of said structure, and anchoring said anchor mechanisms in ground material located on the land side of said structure; and extending one or more cables between each said concrete boulder anchor bolt and said land side anchor mechanisms so that said cables overlie said structure to be protected from erosion.

20. The method of claim 19, further including extending said one or more cables over said structure to be protected from erosion and placing a tension on said one or more cables so as to pull said concrete boulders toward said structure to be protected from erosion.

* * * * *